US012263559B2

(12) United States Patent
Whitman

(10) Patent No.: US 12,263,559 B2
(45) Date of Patent: Apr. 1, 2025

(54) METHOD OF MAINTAINING TOENAILS OF AN ANIMAL

(71) Applicant: Ralph Whitman, Farwell, MI (US)

(72) Inventor: Ralph Whitman, Farwell, MI (US)

( * ) Notice: Subject to any disclaimer, the term of this patent is extended or adjusted under 35 U.S.C. 154(b) by 0 days.

(21) Appl. No.: 18/422,297

(22) Filed: Jan. 25, 2024

(65) Prior Publication Data

US 2024/0157513 A1 May 16, 2024

Related U.S. Application Data

(63) Continuation of application No. 15/393,426, filed on Dec. 29, 2016, now abandoned, which is a continuation-in-part of application No. 14/955,434, filed on Dec. 1, 2015, now abandoned.

(51) Int. Cl.
*B24D 5/10* (2006.01)

(52) U.S. Cl.
CPC ..... *B24D 5/10* (2013.01)

(58) Field of Classification Search
CPC ..... B24B 23/005; B24B 23/02; B24B 23/022; B24B 23/026; B24B 23/028; B24B 41/002
USPC ..... 132/73.6
See application file for complete search history.

(56) References Cited

U.S. PATENT DOCUMENTS 2,807,264 A 9/1957 Tuck
2,861,578 A 11/1958 Thompson
3,142,138 A 7/1964 Kean et al.
3,841,034 A 10/1974 Held
3,965,510 A * 6/1976 Ernst ..... B25B 21/007 7/165
4,218,795 A * 8/1980 Ernst ..... B25B 21/007 7/158
D275,570 S 9/1984 Siden
4,606,154 A 8/1986 Herrmann et al.
4,800,686 A 1/1989 Hirabayashi et al.
4,854,334 A 8/1989 Su
4,977,709 A 12/1990 Siden
5,020,282 A 6/1991 Okajima et al.
5,161,552 A * 11/1992 Kathuria ..... A45D 29/05 132/75.6
5,609,518 A 3/1997 Lucchesi
5,662,515 A 9/1997 Evensen
5,702,294 A 12/1997 Baltazar et al.
5,876,274 A * 3/1999 Hariu ..... B24D 18/0018 451/449
6,007,415 A * 12/1999 Van Osenbruggen ... B24D 7/10 451/528

(Continued)

FOREIGN PATENT DOCUMENTS

CA 2882266 A1 8/2017
DE 20008683 U1 8/2000

*Primary Examiner* — Joel D Crandall
(74) *Attorney, Agent, or Firm* — Joseph P. Kincart; Tracnik Law PLLC

(57) ABSTRACT

Methods of maintaining toenails of an animal that include maintaining a toenail of the animal on a surface of a trimmer head, the trimmer head being circular in configuration and including a forward end having an outside edge of a radial configuration, a rearward end, and an outer surface including an abrasive material. Air is passed through the trimming head thereby cooling the trimming head while maintaining the toenails on the surface of the trimmer head. The toenail of the animal is trimmed by grinding the toenail with the abrasive material.

25 Claims, 20 Drawing Sheets

(56) References Cited

U.S. PATENT DOCUMENTS

| | | | | |
|---|---|---|---|---|
| 6,053,683 | A * | 4/2000 | Cabiran | F16B 37/14 411/374 |
| 6,423,078 | B1 * | 7/2002 | Bays | A61B 17/32 606/131 |
| 6,679,271 | B2 * | 1/2004 | Choe | A45D 29/05 132/200 |
| 7,204,664 | B2 | 4/2007 | Nakanishi et al. | |
| 7,428,881 | B2 * | 9/2008 | Drelinger | A45D 29/05 119/608 |
| 7,568,451 | B2 | 8/2009 | Drelinger | |
| 2001/0011004 | A1 * | 8/2001 | Yamaguchi | B24D 7/06 451/548 |
| 2002/0123302 | A1 * | 9/2002 | Maras | B23D 61/025 451/542 |
| 2003/0228552 | A1 | 12/2003 | Dipietro | |
| 2004/0009744 | A1 * | 1/2004 | Conley | B24D 11/00 451/359 |
| 2009/0179368 | A1 * | 7/2009 | Haimer | B23B 31/1175 408/239 R |
| 2015/0150353 | A1 * | 6/2015 | Yiu | A61B 17/54 132/75.6 |
| 2015/0173484 | A1 * | 6/2015 | Fitzsimons | A45D 29/05 132/200 |
| 2015/0231764 | A1 | 8/2015 | Arisawa et al. | |

* cited by examiner

METHOD OF MAINTAINING TOENAILS OF AN ANIMAL

This application is a continuation application of U.S. application Ser. No. 15/393,426, filed Dec. 29, 2016, which is a continuation-in-part application of U.S. application Ser. No. 14/955,434, filed Dec. 1, 2015, the contents of each of which are incorporated and relied upon by reference herein in their entirety.

FIELD OF THE INVENTION

This invention deals primarily with a device that is hand-held and which is used to trim various objects, for example, the toenails of animals. The device is mechanized, driven by a motor, such as the well-known Dremel® equipment, of an electric drill. The component makeup of the instant device allows for the safe trimming of various objects.

BACKGROUND OF THE INVENTION

Typically, those working in the industry of grooming pets have used scissors and anvil type clippers to trim toenails, but quite often, the same individuals use handheld abrasive devices for the same job.

In recent times, some of those in the industry have turned to hand-held trimmer devices that are mechanized rotary tools that hold abrasive tools. There are many problems associated with such hand-held rotary devices in that they can overheat and cause discomfort to the animal. In addition, such devices can entangle long hair on animals, again at the discomfort of, if not, injury to the animals being groomed. In addition, rotary tools known in the prior art use beveled trimmer heads or purely circular trimmer heads and these configurations tend to displace the nails while trimming.

One such device can be found in U.S. Pat. No. 4,854,334 issued to Su on Aug. 8, 1989, in which there is provided a power supply, a driving means, a switch means, a trimming means, and a frame means for trimming nails.

Another device can be found in U.S. Pat. No. 7,428,881 that issued to Drelinger on Sep. 30, 2008 in which there is provided a device that is a rotary device that has a shroud and an opening in the shroud to allow an animal's nail to be put through the opening and shaped by the rotary grinder.

Drelinger discloses his invention again in U.S. Pat. No. 7,568,451.

THE INVENTION

Thus, what is disclosed and claimed herein is a trimmer head, wherein the trimmer head has a forward end that has an outside edge, a rearward end, and an outer surface. The head has a long axis and is circular in configuration. The head contains on the outer surface, an abrasive material, the outside edge of the forward end is comprised of a radial configuration.

In another embodiment, there is a shank fixedly mounted essentially at a center point in a surface of the rearward end or the trimmer head. The shank comprises a near end and a distal end, wherein the near end is thicker in cross-section than the distal end. The distal end is configured to fit a motorized driving mechanism, the motorized driving mechanism not forming part of this invention.

In additional embodiments, there is a trimmer head wherein, in addition, there is a plurality of through holes through the trimmer head, paralleling the long axis; a trimmer head wherein, in addition, there is a plurality of through holes angled from the long axis; a trimmer head wherein, in addition, there is a plurality of through holes through the trimmer head perpendicular to the long axis; a trimmer head wherein, in addition, there is at least one circumferential groove in the trimmer head; a trimmer head wherein, in addition, there is a plurality of through holes through the trimmer head that are parallel on the long axis and there is at least one circumferential groove in the trimmer head; a trimmer head wherein, in addition, there is a plurality of through holes through the trimmer head, angled with respect to the long axis and, there is at least one circumferential groove in the trimmer head; a trimmer head wherein, in addition, there is a plurality of through holes through the trimmer head perpendicular to the long axis and there is at least one circumferential groove in the trimmer head; a combination of the trimmer head and the shank, wherein, in addition, there is a plurality of through holes through the trimmer head, paralleling the long axis; a combination wherein, in addition, there is a plurality of through titles angled from the long axis; a combination wherein, in addition, there is a plurality of through holes through the trimmer head perpendicular to the long axis a combination wherein, in addition, there it at least one circumferential groove in the trimmer head; a combination wherein, in addition, there is a plurality of through holes through the trimmer head that are parallel to the long axis and there is at least one circumferential groove in the trimmer head; a combination wherein, in addition, there is a plurality of through holes through the trimmer head, perpendicular to the long axis and, there is at least one circumferential groove in the trimmer head; a combination wherein, in addition, there is a plurality of through holes through the trimmer head, angled with respect to the long axis and, there is at least one circumferential groove in the trimmer head a trimmer head wherein, in addition, the trimmer head has a concave center portion; a trimmer head having a concave surface in combination with a shank, the shank being fixedly mounted essentially at a center point in a surface of the rearward end, the shank comprising a near end and a distal end, the near end being thicker in cross-section than the distal end, the distal end being configured to fit a motorized driving mechanism; a trimmer head having a shank and a concavity wherein, in addition, there is a plurality of through holes through the trimmer head, paralleling said long axis; a trimmer head having a concave surface wherein, in addition, there is a plurality of through holes through the trimmer head, angled with respect to the long axis; a trimmer head having a concave surface wherein, in addition, there is a plurality of through holes through the trimmer head, perpendicular to the long axis; a trimmer head having a concave surface wherein, in addition, there is a plurality of through holes through the trimmer head, paralleling said long axis and there is at least one circumferential groove in the trimmer head; a trimmer head having a concave surface wherein, in addition, there is a plurality of through holes through the trimmer head, angled with respect to the long axis and, there is at least one circumferential groove in the trimmer head; a trimmer head having a concave surface wherein, in addition, there is a plurality of through holes through the trimmer head, perpendicular to the long axis and, there is at least one circumferential groove in the trimmer head; a combination of a trimmer head having a concave surface and a shank wherein, in addition, there is at least one circumferential groove in the trimmer head; a combination of a trimmer head having a concave surface and a shank wherein, in addition, there is a plurality of through holes through the trimmer head, paralleling the long axis; a combination of a trimmer head having a concave surface and a shank wherein, in addition, there is a plurality of through holes through the trimmer head, angled with respect to the long axis; a combination of a trimmer head having a concave surface and a shank wherein, in addition, there is a plurality of through holes through the trimmer head, perpendicular to the long axis a combination of a trimmer head having a concave surface and a shank wherein, in addition, there is a plurality of through holes through the trimmer head paralleling the long axis and there is at least one circumferential groove in the trimmer head; a combination of a trimmer head having a concave surface and a shank wherein, in addition, there is a plurality of through holes through the trimmer head angled with respect to the long axis and, there is at least one circumferential groove in the trimmer head; a combination of a trimmer head having a concave surface and a shank wherein, in addition, there is a plurality of through holes through the trimmer head perpendicular to the long axis and, there is at least one circumferential groove in the trimmer head.

Also contemplated within the scope of this invention are trimmer heads that do not have a shank for attachment to power tools, but instead have openings in the rearward end of the trimmer head for insertion of shafts that are mounted on power tools.

DETAILED DESCRIPTION OF THE DRAWINGS

Figure 1:
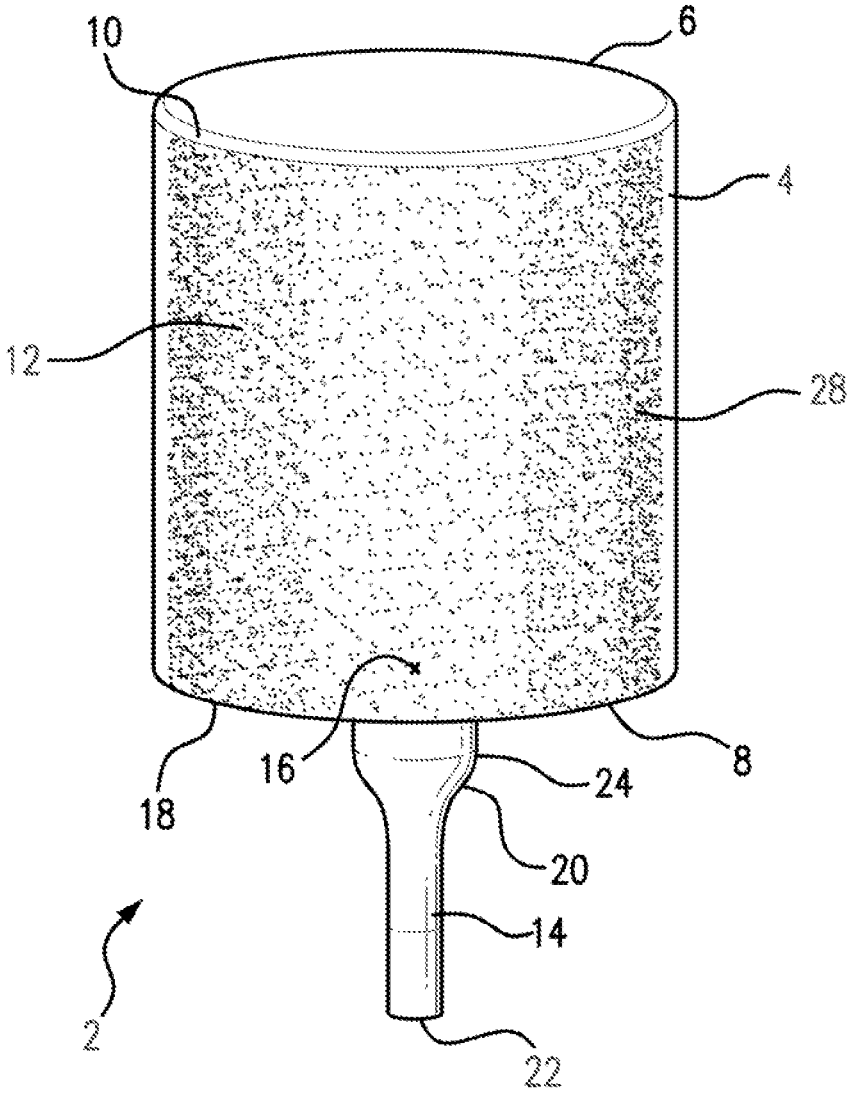
FIG. 1 is a full side view of a device of this invention.

FIG. 1 is a full side view of a device 2 of this invention. The device 2 has a head portion 4 that has a forward end 6 and a rearward end 8. The rearward end 8 has rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This motorized driving mechanism is the same type or similar to a drill or a Dremel device. There is also an outside edge 10. In this embodiment the outside surface 12 is an abrasive surface 28.

A variety of abrasive surfaces may be used in the invention herein, but in a preferred embodiment, the abrasive surface can be a surface bonded to the head. The abrasive can be a coating such as spray on coatings, concave paper sending bands, and the like. Preferably, an abrasive surface includes metal-bonded industrial diamond, for example, nickel-plated industrial diamond, yet others may prefer other methods of bonding and other abrasives. For example, others may prefer using a glue or composite to bond other abrasives or industrial diamond. Still, others may prefer other abrasives, for example, flint, garnet, emery, aluminum oxide, silicon carbide, alumina-zirconia, chromium oxide, ceramic aluminum oxide, or mixtures of any of them.

As long as the abrasive is hard enough to grind the nail of an animal, the abrasive will perform with some level of success. Alternatively, abrasive surface may be created by casting on of a material having abrasive properties, for example, a composite which includes abrasive material, or by texturizing the surface of the head, for example, by cutting fine grooves or notches into the surface of the head. All such embodiments are considered to be within the scope of the instant invention. Where particulate materials are used, the abrasive has a particle size of about 5000 grit to about 20 grit, that is based on Coated Abrasive Manufacturers Institute standards. More preferable, the abrasive size is about 150 to about 100, and most preferable is about 120.

It should be further noted that the outside edge 10 of the forward end 6 contains a radius configuration, or a rounded edge, such that long hairs and other similar objects will not be caught by the outside edge 10, and such an edge 10 will not cut or abrade the animal or the user.

Figure 2:
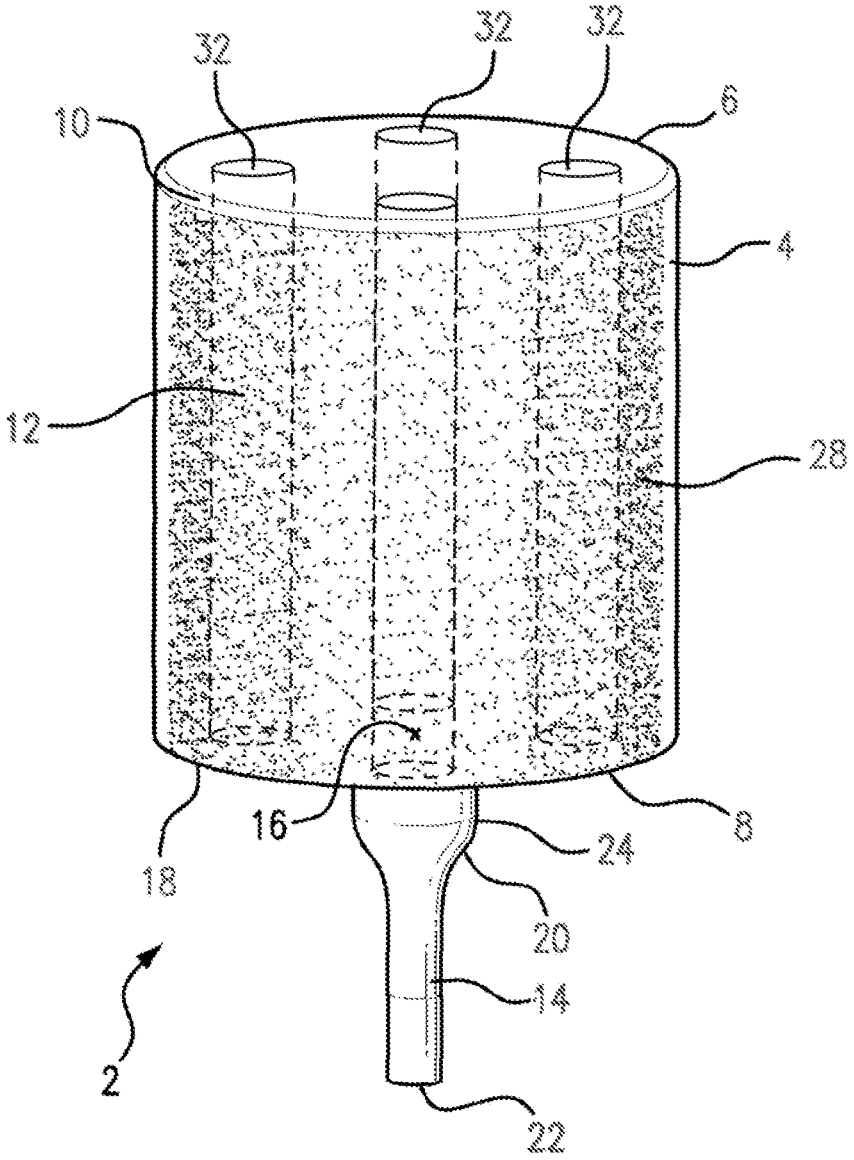
FIG. 2 is a full side view of another device of this invention.

FIG. 2 is a full side view of one device 2 of this invention. This embodiment of the device 2 has a head portion 4 that has a forward end 6 and a rearward end 8. The rearward end 8 has a rearward surface 18 that has a center point 16 that shows the position of the shank 14. The shank 14 has a near end 20 and a distal end 22. The near end 20 of the shank 14 has a thicker portion 24 than the thinner distal end 22. The distal end 22 is configured to fit a motorized driving mechanism.

The outside surface 12 in this embodiment can be an abrasive material 28, such as, for example, diamond formed by electroplating. There are through holes 32 that extend from the forward end 6 through to the rearward end 8. These holes 32 are aligned from the forward end 6 to the rearward end 8 of the trimmer head 4. In this embodiment, it should be noted that the holes 32 are situated in the trimmer head 4 such that they do not intercept the outside surface 12 of the trimmer head 4. The holes 33 promote cooling of the trimmer head 4.

Figure 3:
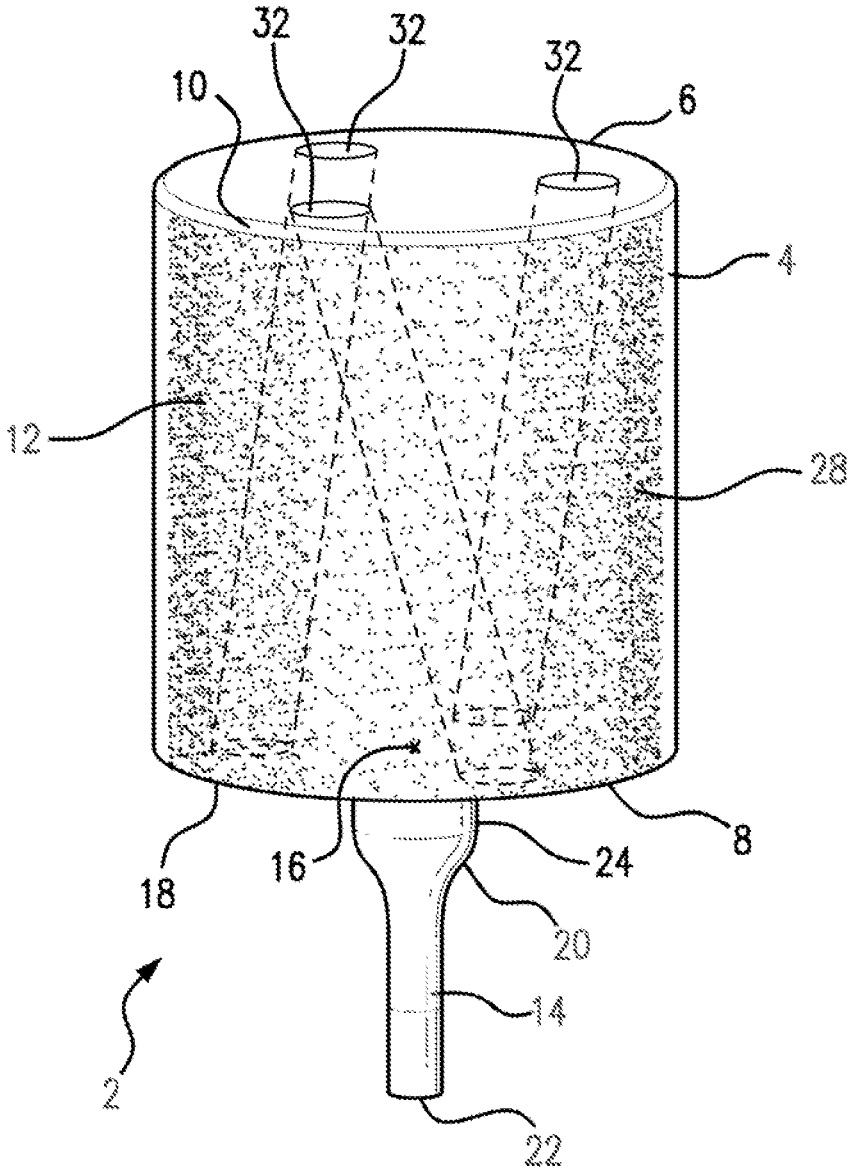
FIG. 3 is a full side view of another embodiment of a device of this invention.

FIG. 3 is a full side view of another embodiment of the device 2. This embodiment of the device 2 has a head 4 portion that has a forward end 6 and a rearward end 8. The rearward end 8 has a rearward surface 18 that has a center point 16 that shows the position of the shank 14. The shank 14 has a near end 20 and a distal end 22. The near end 20 of the shank 14 has a thicker portion 24 than the thinner distal end 22. The distal end 22 is configured to fit a motorized driving mechanism.

In this embodiment the holes 32 are angled from the forward end 6 to the rearward end 8 instead of being aligned parallel to the long axis of the head 4. As in the other embodiments the outside surface 12 is an abrasive surface 28.

Figure 4:
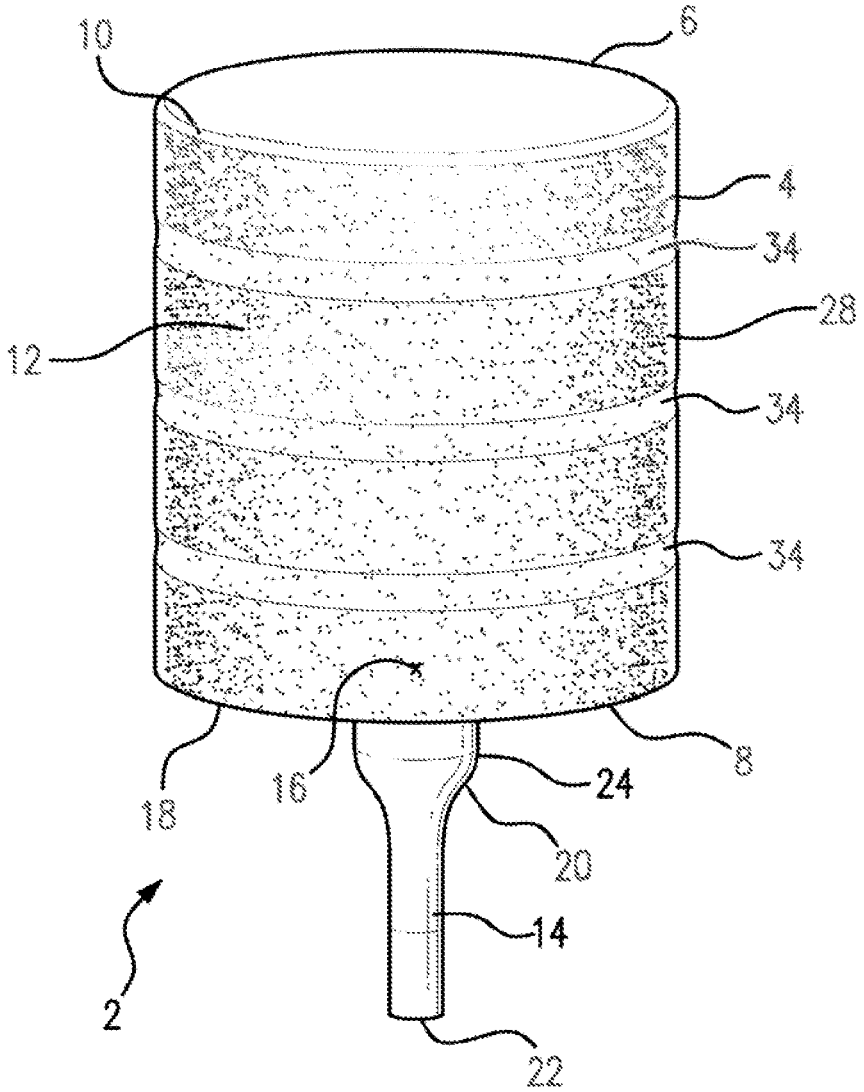
FIG. 4 is a full side view of another embodiment of a device of this invention.

FIG. 4 is a full side view of another embodiment of the device 2. This embodiment of the device 2 has a head 4 portion that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment contains at least one circumferential groove 34.

Figure 5:
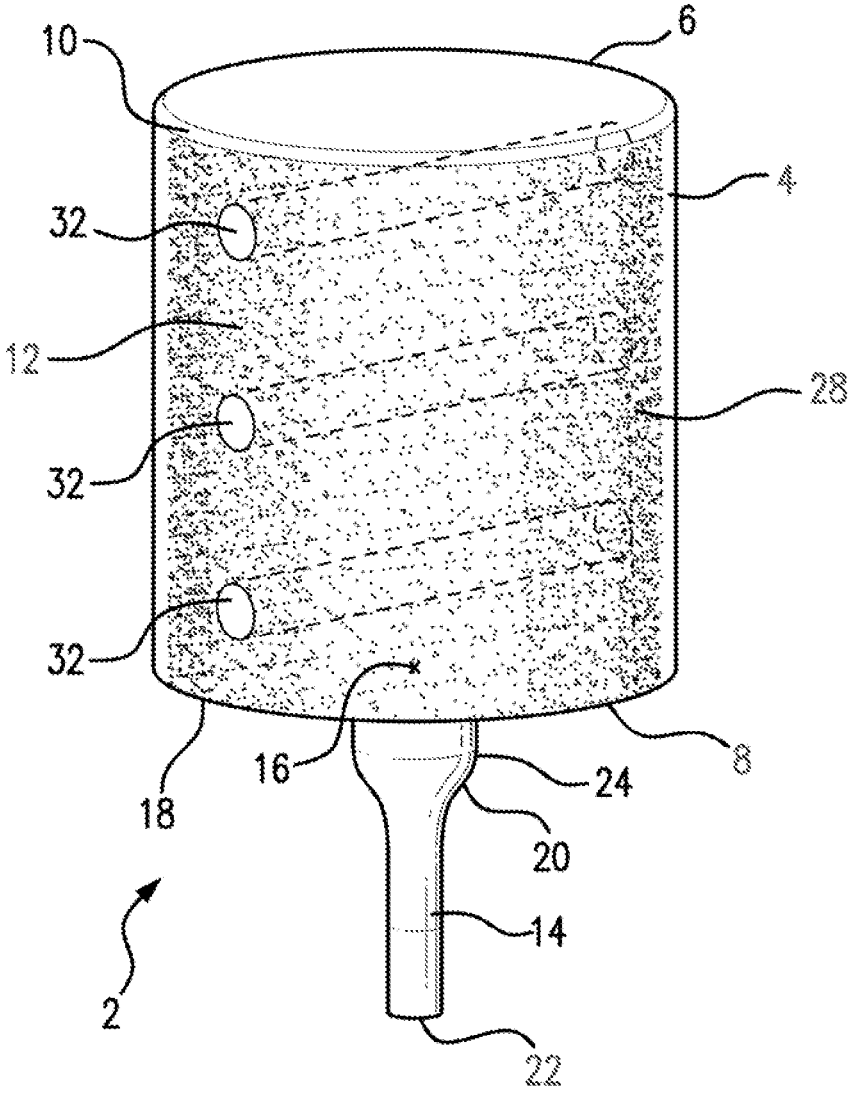
FIG. 5 is a full side view of another embodiment of a device of this invention.

FIG. 5 is a full side view of another embodiment of the device 2. This embodiment of the device 2 has a head portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. The holes 32 are aligned perpendicular to the long axis of the head. The holes 32 allow for trimmer head 4 cooling.

Figure 6:
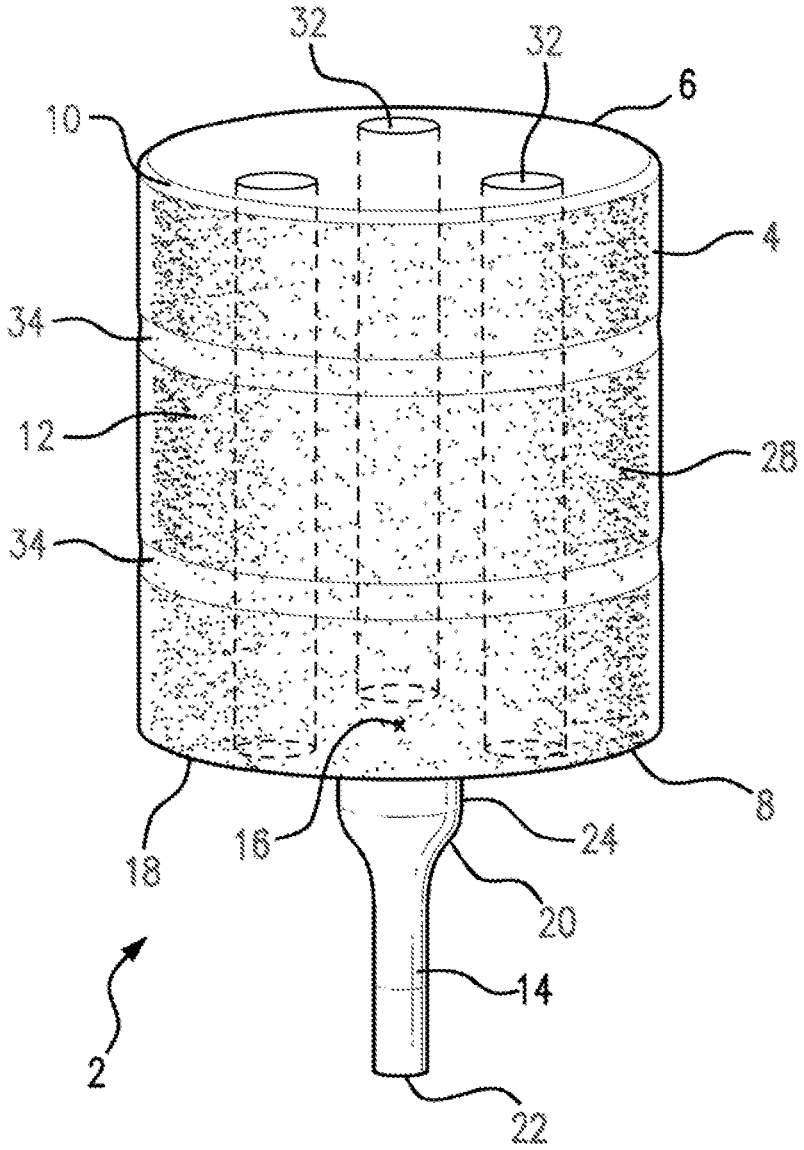
FIG. 6 is a full side view of another embodiment of a device of this invention.

FIG. 6 is a full side view of another embodiment of the device 2. This embodiment of the device 2 has a head portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment also has an abrasive surface 28 on the outer surface 12.

There are circumferential grooves 34 milled into the trimmer head 4 in a circumferential manner. These circumferential grooves 34 are milled such that they may intersect with the air holes 32. This configuration allows for even more air to flow through the trimmer head 4 and helps alleviate heating of the trimmer head 4 while in use. The circumferential grooves 34 are nominally about 0.009 to about 0.90 inches thick and can vary in size according to the animal being created. Preferred is about 0.024 inches. It is usually sufficient to allow one such circumferential groove 34, but this figure shows three such circumferential grooves 34 in the trimmer head 4.

Figure 7:
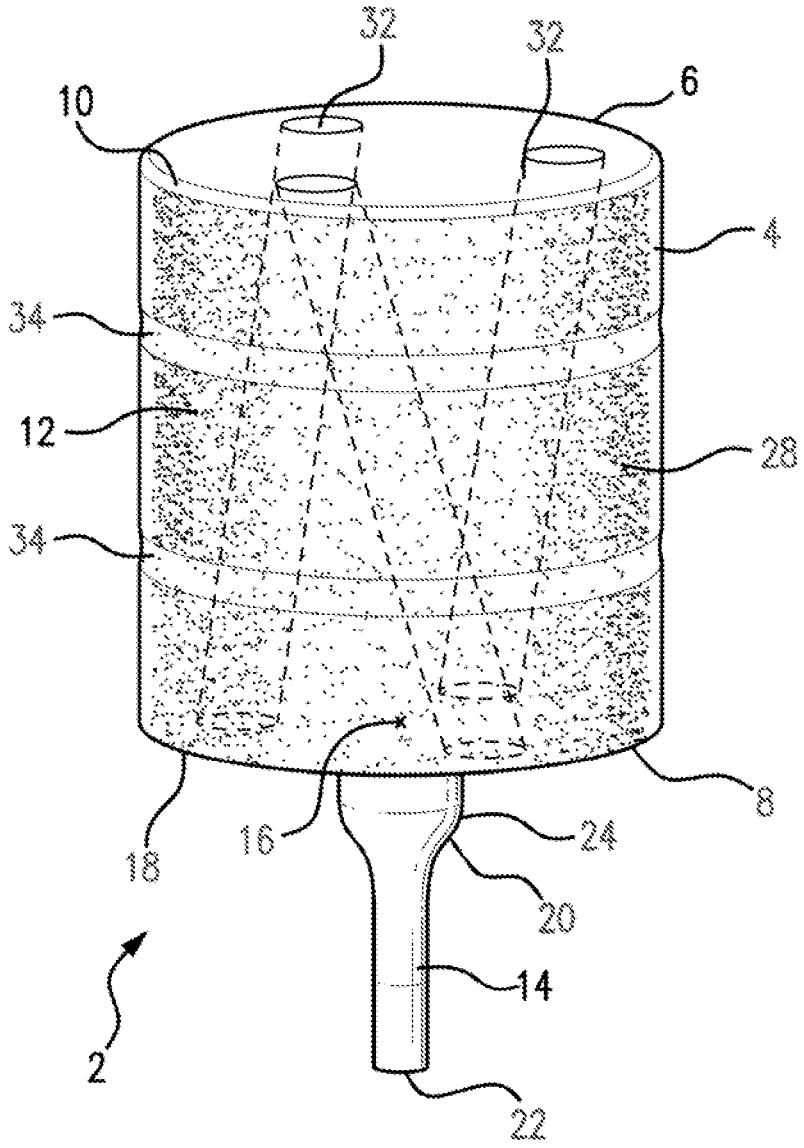
FIG. 7 is a full side view of another embodiment of a device of this invention.

FIG. 7 is a full side view of another embodiment of the device 2. This embodiment of the device 2 has a head portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment also has an abrasive surface 28 on the outer surface 12.

This embodiment has holes 32 that are angled from the forward end 6 to the rearward end 8 instead of being aligned parallel to the long axis. As in the other embodiments, the outside surface 12 has an abrasive surface 28.

There are circumferential grooves 34 milled into the trimmer head 4 is a circumferential manner. There circumferential grooves 34 are milled such that they may intersect with the air holes 32. The holes 32 are angled. This configuration allows for even more air to flow through the trimmer head 4 and helps alleviate heating of the trimmer head 4 while in use.

Figure 8:
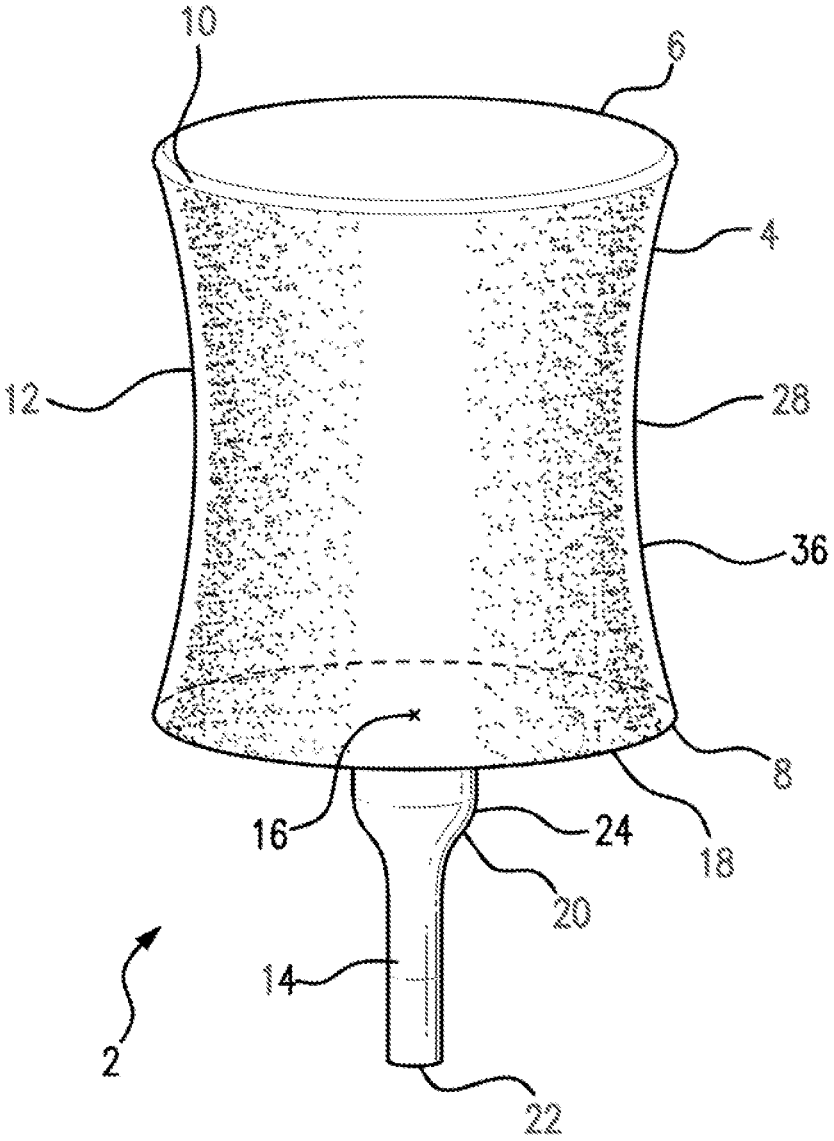
FIG. 8 is a full side view of another embodiment of a device of this invention.

FIG. 8 is a full side view of another embodiment of the device 2. This embodiment of the device 2 has a need portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment also has an abrasive surface 28 on the outer surface 12.

In this embodiment, the trimmer head has a concave center portion 36. It should also be noted that this concave portion is radiused, then is concave in the middle, to help keep toenails in place when grinding.

Figure 9:
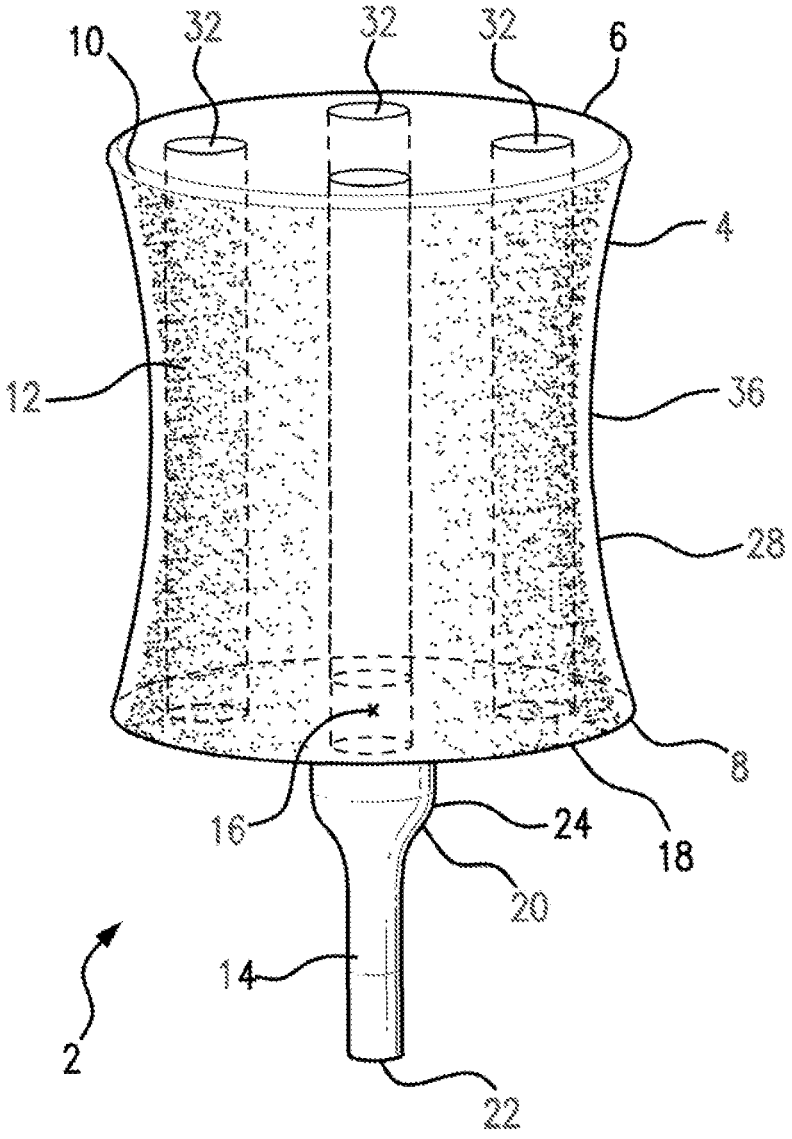
FIG. 9 is a full side view of another embodiment of a device of this invention.

FIG. 9 is a full side view of another embodiment of the device 2. The device 2 has a head portion 4 that has a forward end 6 and a rearward end 8. The rearward end 8 has rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This motorized driving mechanism is the same type or similar to a drill or a Dremel. There is also an outside edge 10. In this embodiment the outside surface 12 is an abrasive surface 28.

There are through holes 32 that extend from the forward end 6 through to the rearward end 8. These holes 32 are aligned parallel to the long axis from the forward end 6 to the rearward end 8 of the bead 4. In this embodiment, it should be noted that the holes 32 are situated in the trimmer head 4 such that they may not intercept the outside surface 12 of the trimmer head 4. The holes 32 promote cooling of the trimmer head 4.

It should be further noted that the outside edge 10 of the forward end 6 contains a radius configuration, or a rounded edge, such that long hairs and other similar objects will not be caught by the outside edge 10, and such an edge 10 will not cut or abrade the animal or the user.

In this embodiment the holes 32 are aligned from the forward end 6 to the rearward end 8 of the trimmer 2. It should foe noted that the holes 32 are situated in the trimmer head 4 such that they may not intercept the outside surface 12 of the trimmer head 4.

It should be further noted that in this embodiment the trimmer head 4 has a concave center portion 36.

Figure 10:
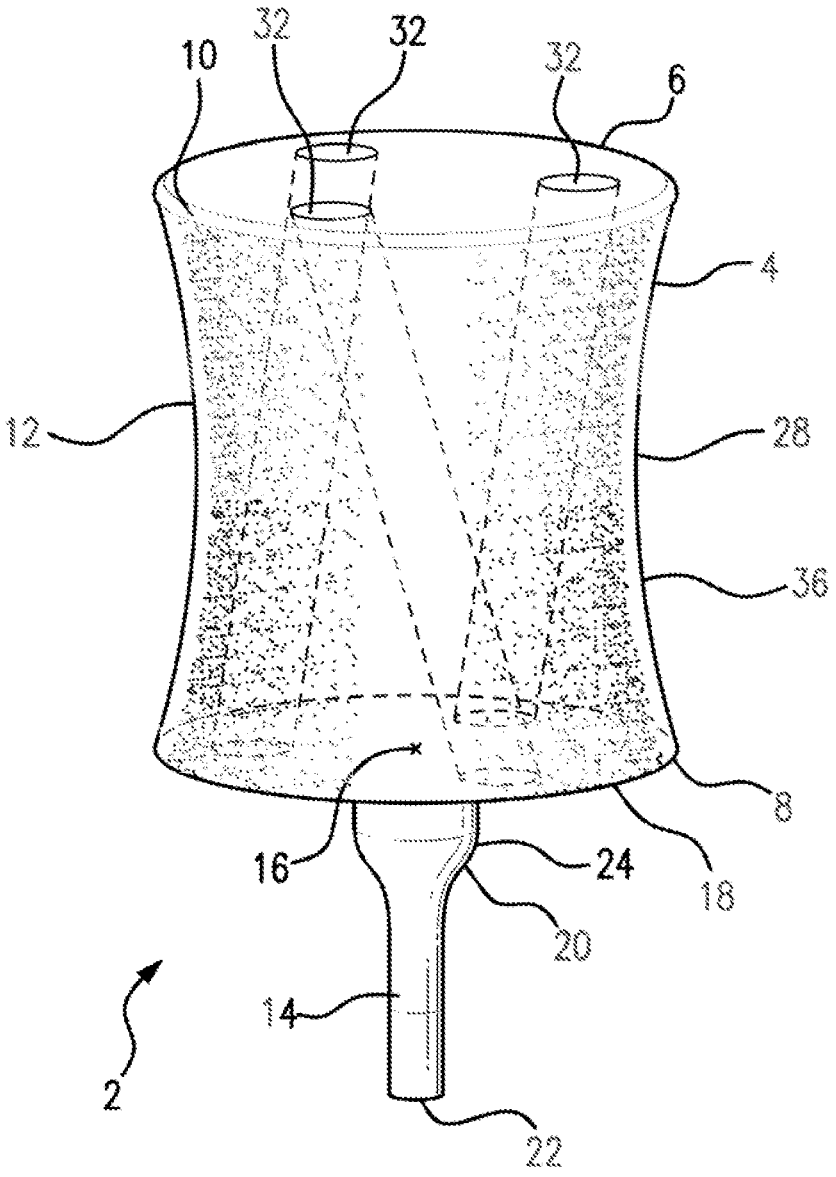
FIG. 10 is a full side view of another embodiment of a device of this invention.

FIG. 10 is a full side view of another embodiment of the device 2. This embodiment of the device 2 has a head portion 4 that has a forward end 6 and a rearward end 8. The rearward end 8 has a rearward surface 18 that has a center point 16 that contains the shank 14. The shank 14 has a near end 20 and a distal end 22. The near end 20 or the shank 14 has a thicker portion 24 than the thinner distal end 22. The distal end 22 is configured to fit a motorized driving mechanism.

In this embodiment, the holes 32 are angled from the forward end 6 to the rearward end 8 instead of being aligned with the long axis. As in the other embodiments the outside surface 12 has an abrasive surface 28.

In this embodiment the holes 32 are aligned from the forward end 6 to the rearward end 8 of the device 2. In this embodiment, it should be noted that the holes 32 are situated in the trimmer head 4 such that they may not intercept the outside surface 10 of the trimmer head 4. The holes 32 promote cooling of the trimmer head 4.

It should be further noted that this embodiment the trimmer head 4 has a concave center portion 36.

Figure 11:
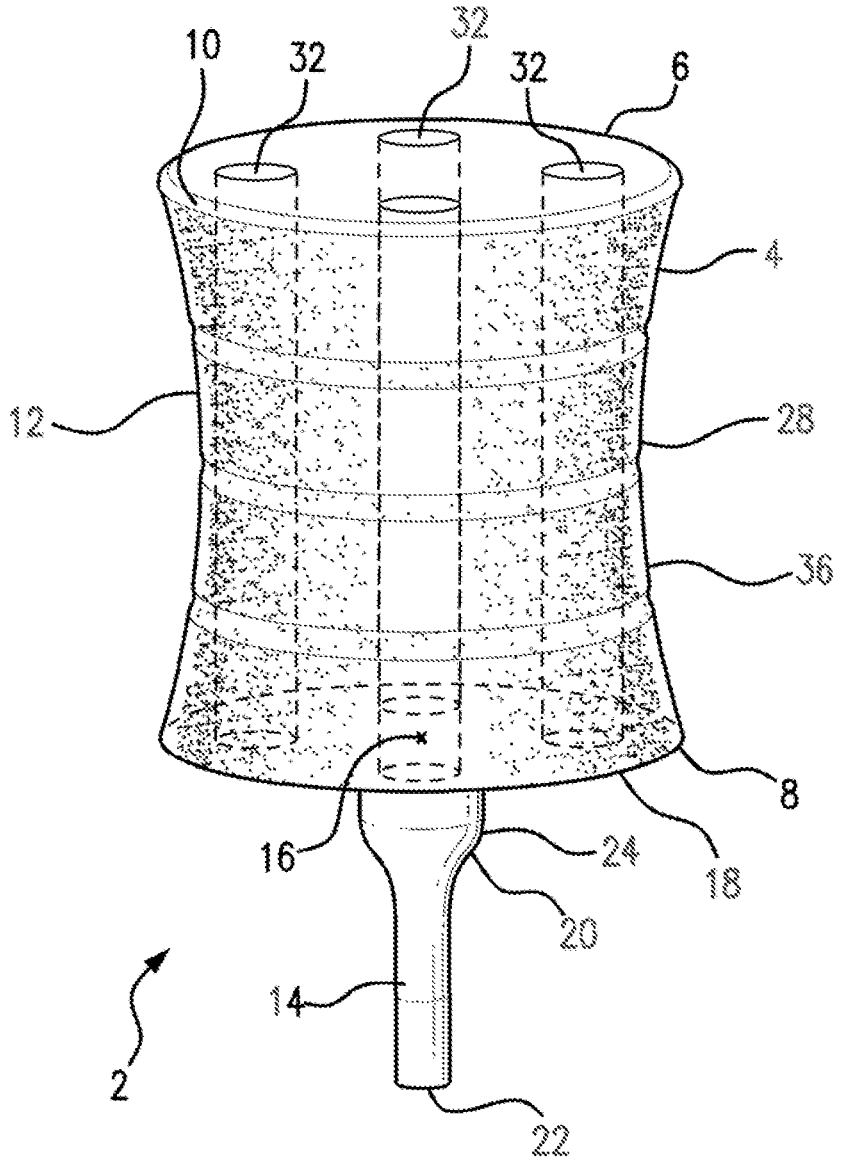
FIG. 11 is a full side view of another embodiment of a device of this invention.

FIG. 11 is a full side view of another embodiment of the device 2. This embodiment of the device 2 has a bead portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment also has an abrasive surface 28 on the outer surface 12.

There are through holes 32 chat extend from the forward end 6 through to the rearward end 8. These holes 32 are aligned from the forward end 6 to the rearward end 8 of the trimmer 2. In this embodiment, it should be noted that the holes 32 are situated in the trimmer head 4 such that they may intercept the outside surface 12 of the trimmer head 4. The holes 32 promote cooling of the trimmer head.

There are circumferential grooves 34 milled into the trimmer head 4 in a circumferential manner. These circumferential grooves 34 are milled such that they intersect with the air holes 32. The holes 32 are vertical here. This configuration allows for even more air to flow through the trimmer head 4 and helps alleviate heating of the trimmer head 4 while in use.

It is usually sufficient to allow one such circumferential groove 34, but this Figure shows three such circumferential grooves 34 in the trimmer head 4.

It should be further noted that this embodiment the trimmer head 4 has a concave center portion 36.

Figure 12:
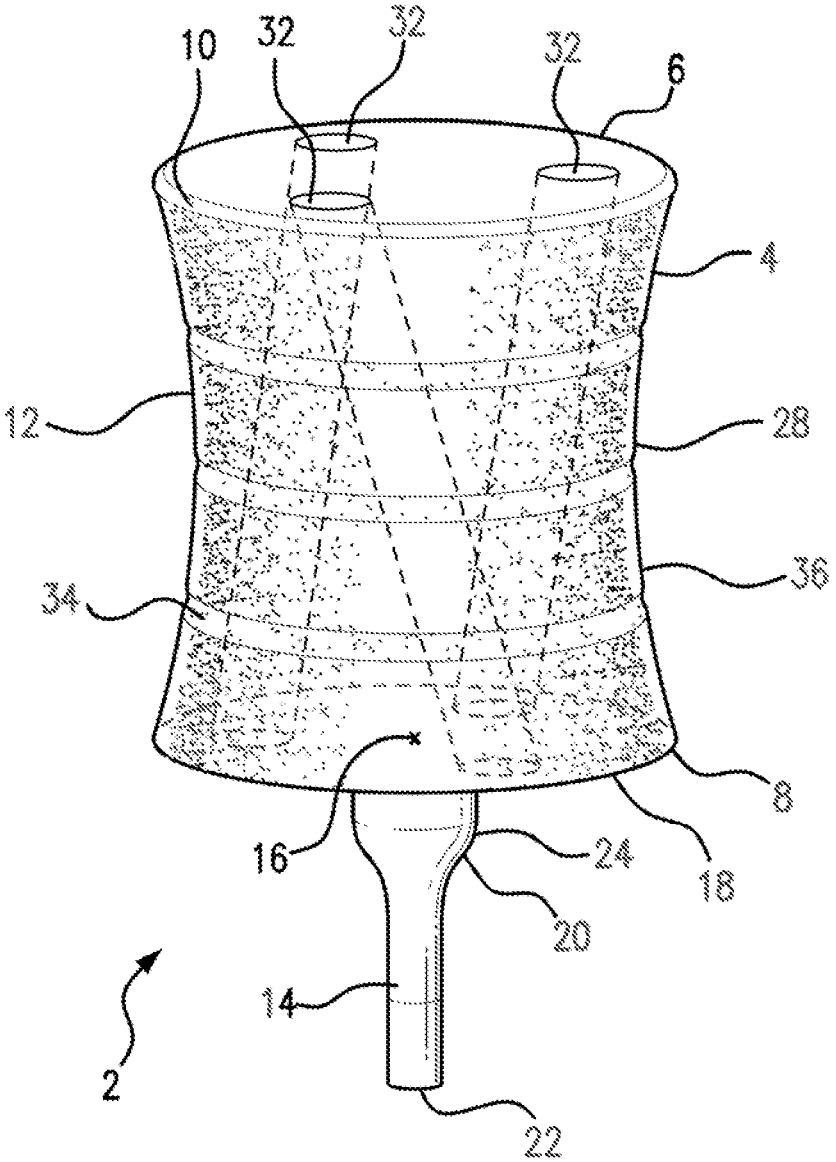
FIG. 12 is a full side view of another embodiment of a device of this invention.

FIG. 12 is a full side view of another of the device 2. This embodiment of the device 2 has a head portion 4 that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment also has an abrasive surface 28 on the outer surface 12.

This embodiment has the holes 32 are angled from the forward end 6 to the rearward end 8 instead of aligned along the long axis. As in the other embodiments the outside surface 12 has an abrasive surface 28.

There are circumferential grooves 34 milled into the trimmer head 4 in a circumferential manner. These circumferential grooves 34 are milled such that they may intersect with the air holes 32. The holes 32 are angled here. This configuration allows for even more air to flow through the trimmer head 4 and helps alleviate heating of the trimmer head 4 while in use.

It should be further noted that this embodiment the trimmer head 4 has a concave center portion 36.

Figure 13:
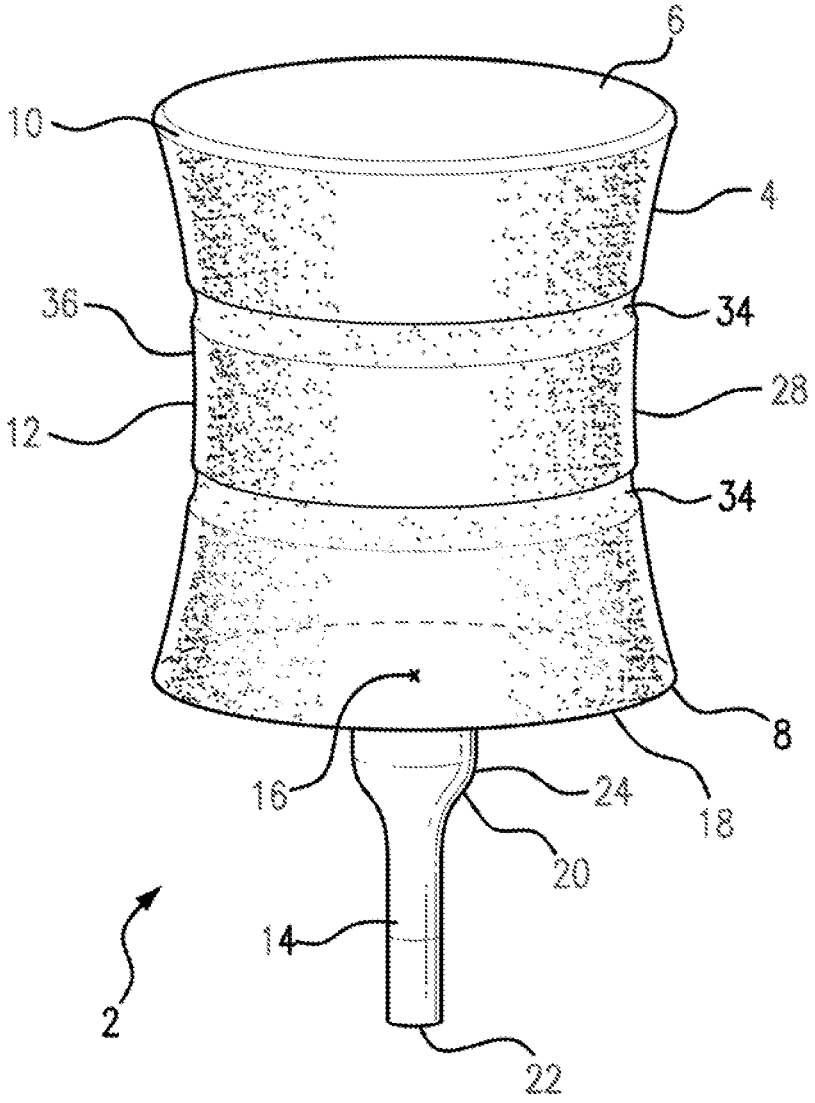
FIG. 13 is a full side view of another embodiment of a device of this invention.

FIG. 13 is a full side view of another embodiment of the device 2. This embodiment of the device 2 has a head portion 4 that has a forward end 6 and a rearward end 8. The rearward end 8 has a rearward surface 18 chat has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. This embodiment contains circumferential grooves 34.

It should be further noted that this embodiment the trimmer head 4 has a concave center portion 36.

Figure 14:
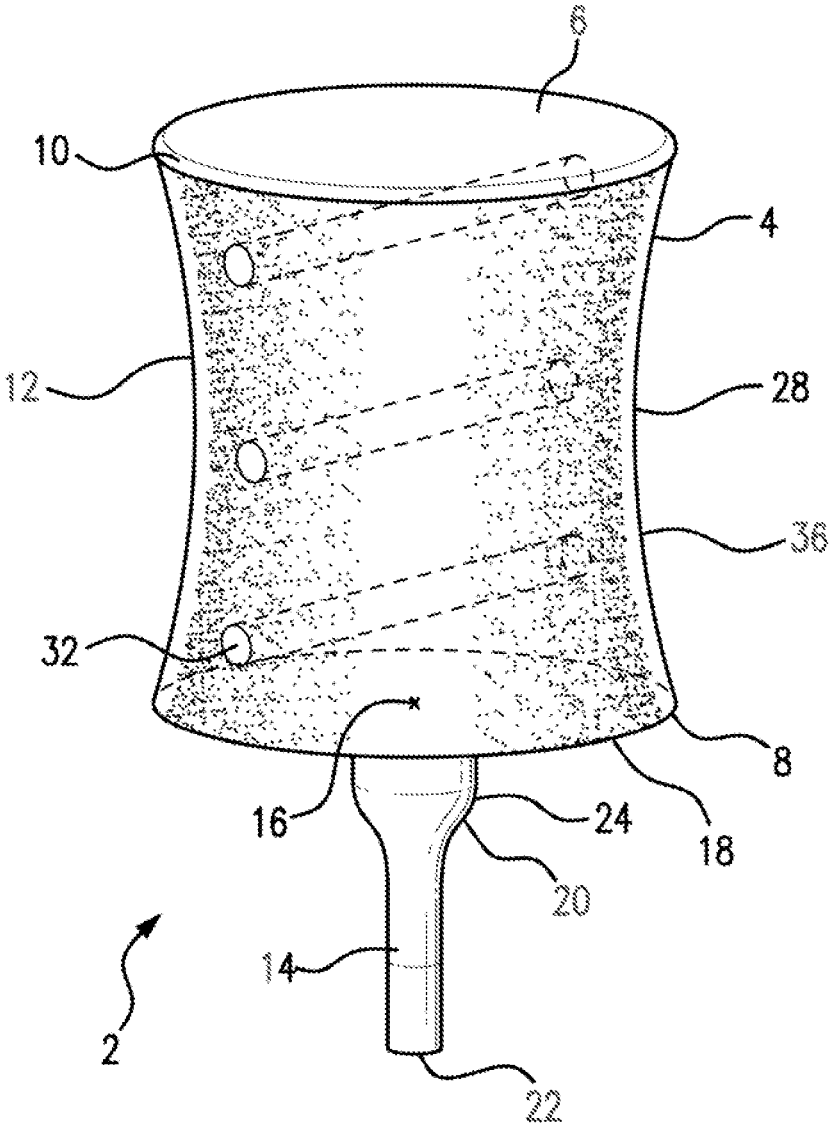
FIG. 14 is a full side view of another embodiment of a device of this invention.
Figure 15:
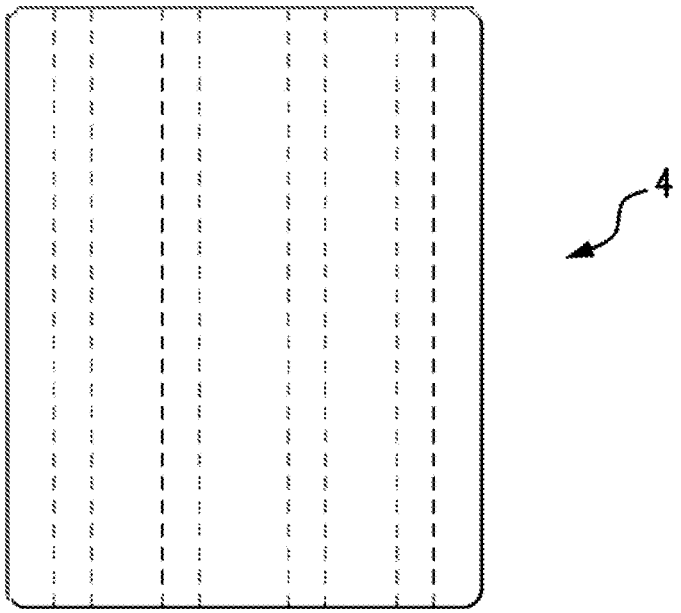
FIG. 15 is a full side view of a trimmer head or this invention.
Figure 16:
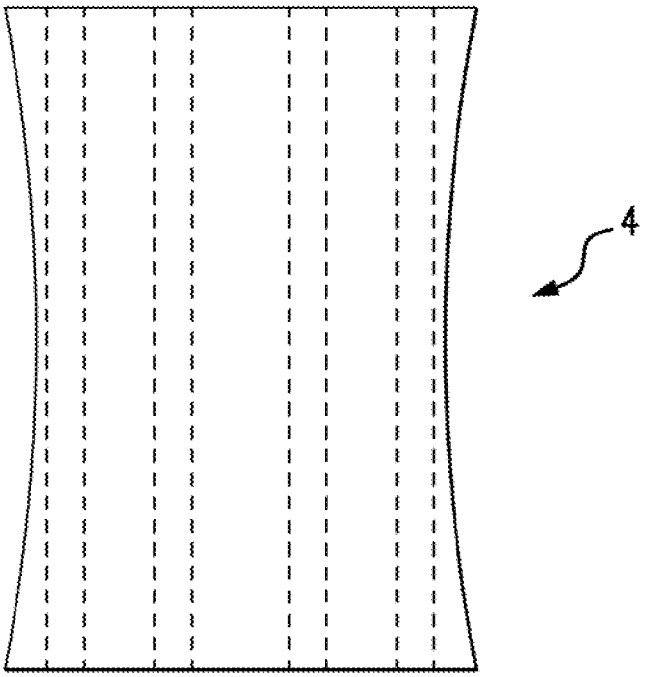
FIG. 16 is a full side view of a trimmer head of this invention.

FIG. 14 is a full side view of another embodiment of the trimmer 2. This embodiment of the trimmer 2 has a head 4 portion that has a forward end 6 and a rearward end 8. The rearward end 8 has a rearward surface 18 that has a center point 16 that contains the shank 14. The shank 14 has a near end 20 and a distal end 22. The near end 20 of the shank 14 has a thicker portion 24 than the thinner distal end 22. The distal end 22 is configured to fit a motorized driving mechanism. The holes 32 may pass through the outside surface 12. The holes 32 again allow for trimmer head 4 cooling.

It should be further noted that this embodiment the trimmer head 4 has a concave center portion 36.

The shank 14 is normally a standard shank that fits rotary tools such as Dremel rotary tools, electric drills, and the like. The shank 14 is thicker near the rearward end 8 of the trimmer head 4 to increase the strength of the shank 14.

The outside surface 12 of the trimmer head 4 is an abrasive surface 28.

The air holes 32 in the trimmer head 4 are placed there to convey air through the trimmer head 6 to alleviate heating of the trimmer head 4 while in use.

Figure 17:
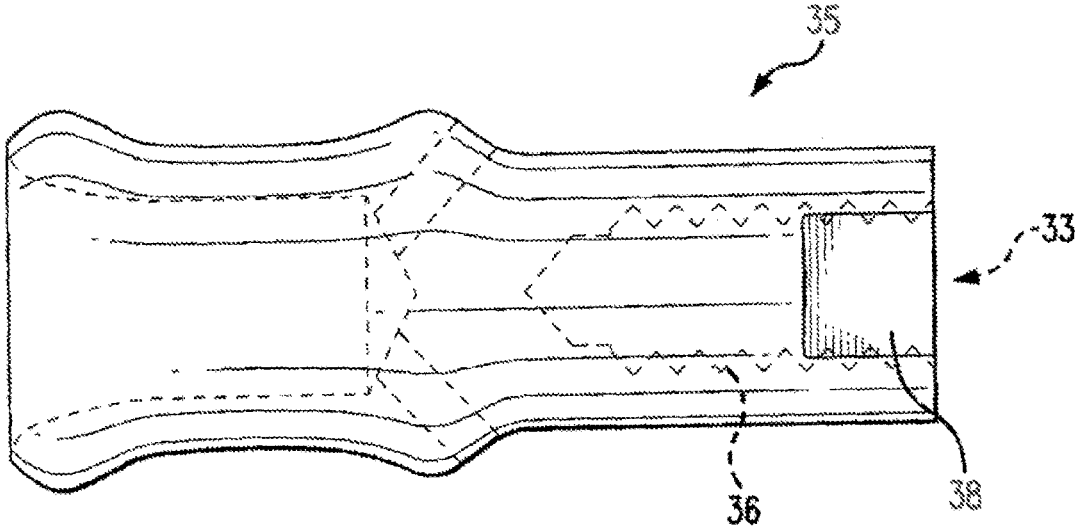
FIG. 17 is a full side view of one internally threaded head of this invention.
Figure 18:
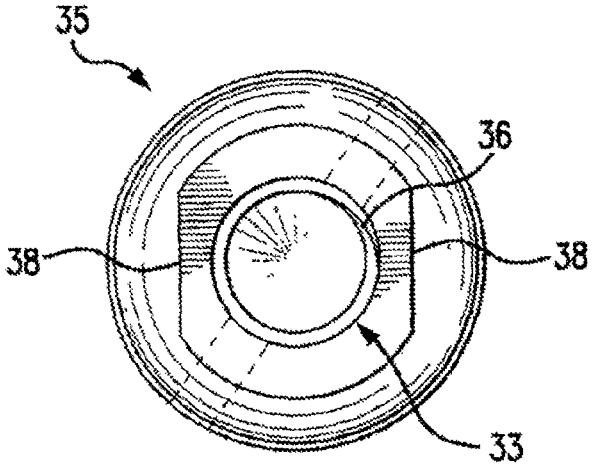
FIG. 18 is a full end view of the device of FIG. 17.
Figure 19:
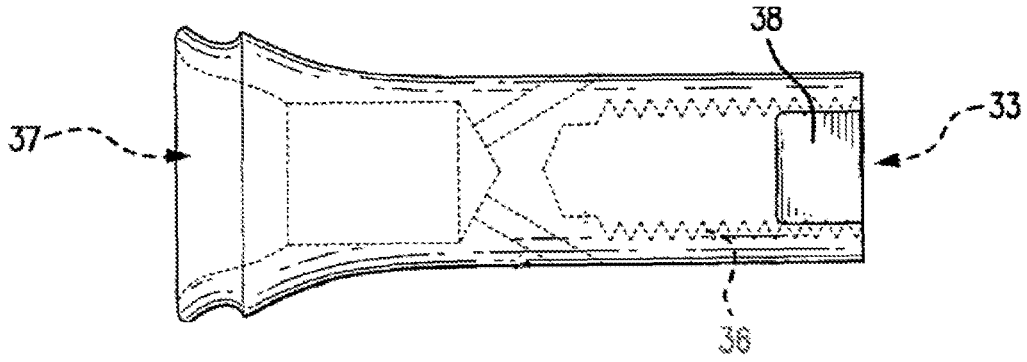
FIG. 19 is a full side view of a device of this invention that is especially useful for human finger and toenails.
Figure 20:
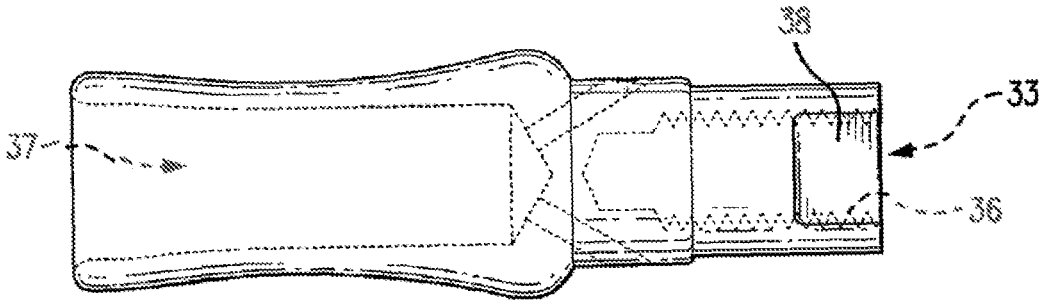
FIG. 20 is a full side view of a device of this invention that is especially useful for boxer dog toenails.
Figure 21:
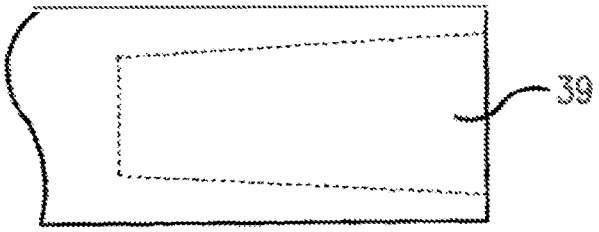
FIG. 21 is a full side view of a device of this invention showing the tapered press fit configuration.
Figure 22:
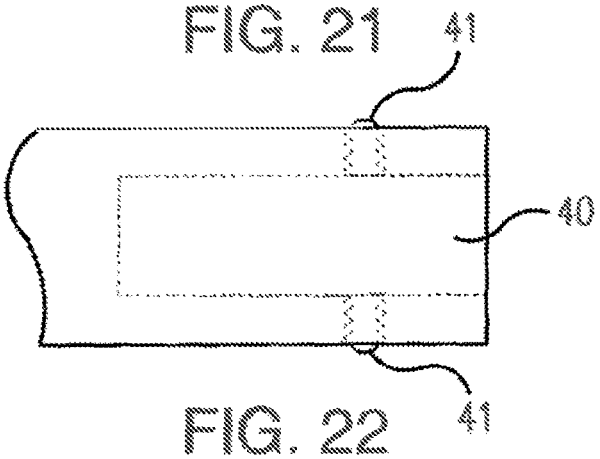
FIG. 22 is a full side view of a device of this invention showing the opening requiring at least one set screw.
Figure 23:
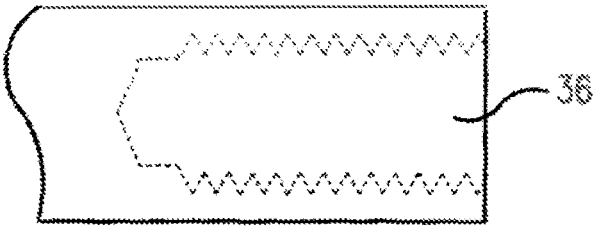
FIG. 23 is a full side view of a device of this invention showing the threaded opening without a wrench pad.
Figure 26:
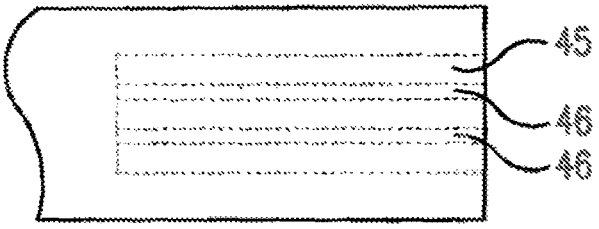
FIG. 26 is a full side view of a device of this invention showing the splined opening.
Figure 24:
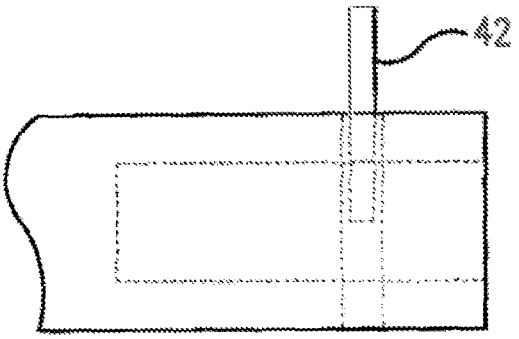
FIG. 24 is a full side view of a device of this invention showing the opening using at least one retaining pin.
Figure 25:
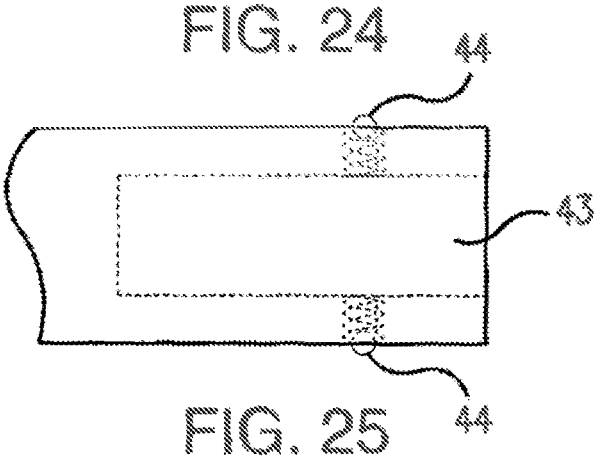
FIG. 25 is a full side slew of a device of this invention showing the opening that requires a spring-loaded button.
Figure 27:
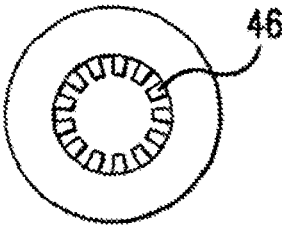
FIG. 27 is a full end view of a device of this invention showing one configuration of splines.
Figure 28:
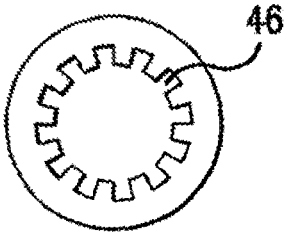
FIG. 28 is a full end view of a device of this invention showing an additional configuration of splines.

In another embodiment of the invention, there is shown in FIG. 17, a full side view of a device that has internal threads 36. This invention is not limited to the device 35, but also contemplates other attachment configurations, such as the tapered press fit 39 shown in FIG. 21, additional shaped openings 40 as shown in FIG. 22 that requires at least one set screw 41, threaded openings 23 without a wrench pad 38, an opening as shown in FIG. 24 using at least one retaining pin 42 to secure it, an opening 43 that requires at least one spring loaded button 44 for securement, splined openings 45 as shown in FIG. 26, with splines 46. FIGS. 27 and 28 are full end views of the splined openings 45 showing two configurations of splines 46.

The openings described Supra may be round, oval, square, triangular with flat surfaces for the set screws and other retaining devices.

These devices are especially useful in those power tools that have insufficient bearings in the drive end of the power tool. These devices allow for diminishing the vibration of the head while being driven by the power tool. The insufficient bearings allow for a fair amount of vibration and these devices will decrease or eliminate such vibration.

In use, the collet is removed from the power tool. The shaft of the power tool is threaded and thus will insert into the opening 33 of the devices of FIGS. 17, 19, and 20 and tighten therein. There is an additional opening 3 shown in phantom in FIGS. 17, 19, and 20. This opening 37 allows for air to move in and out of the device to cool it. Thus, there is shown in FIGS. 17, 18, 19, and 20, the shaft opening 33 and the internal threads 36, the openings and threads in the Figures being shown in Phantom.

It should be noted that there is a wrench pad 38 on each device 17, 19 and 20. There is an equivalent pad on the opposite side of the device. These two pads allow one to turn the device onto the shaft of the power tool and to remove the device from the power tool shaft.

Thus, the devices of the instant invention provide a means of trimming toenails of animals and humans that is safe for the operator, safe for the animal or human being treated, is lightweight (hand held), provides for maintaining toenails on the surface of the trimmer head, and is configured such that the trimmer head does not overheat.

The number of openings or holes in each head can be as many as is desired by the user. There is no limitation with regard to the number of the holes in the head, or the size of the holes in the head, or the exact configurations of the holes in the head. Configurations can be, for example, as shown in the drawings herein, round, but they could be triangular, square, rectangular, octagonal, etc., depending on the desires of the user and objectives of use.

In addition, the particular angle from the long axis as recited herein is not critical and can be any angle that will allow the air to pass through and cool the device and impair the end use of the device.

Figure 29:
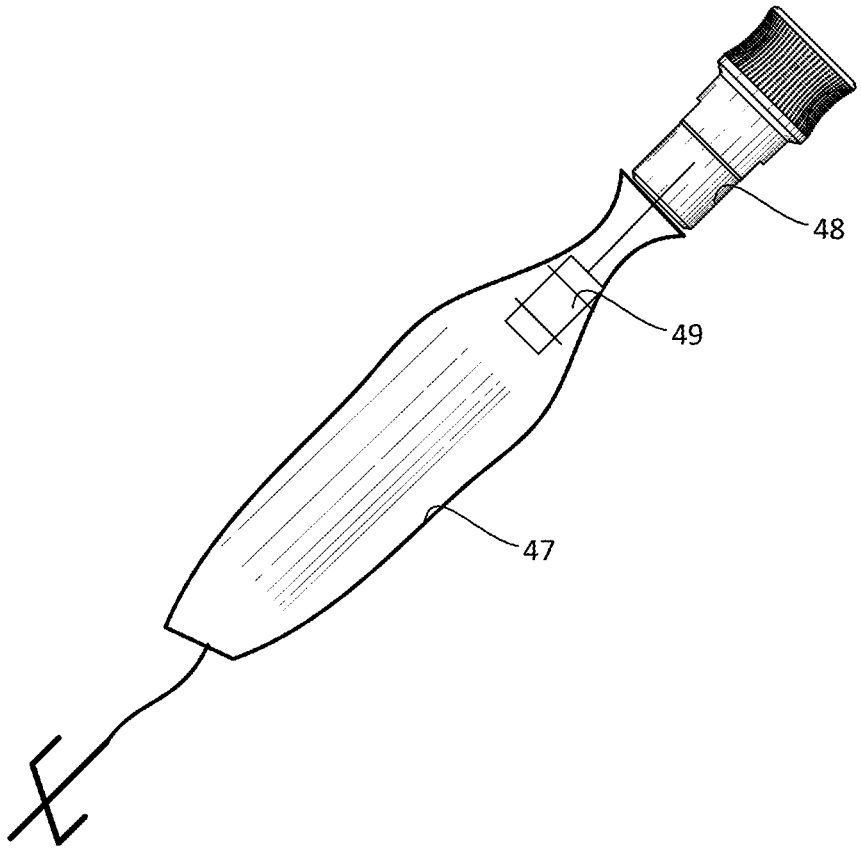
FIG. 29 is a schematic view of a handheld rotary power tool and trimmer head.

Referring now to FIG. 29, a rotary power tool 47 is illustrated with a motor 49, and a trimmer head 48 attached. The rotary power tool 47 may, for example, be a Dremel tool.

What is claimed is:

1. A method of maintaining toenails of an animal, the method comprising:

a. placing and holding a toenail on a surface of a trimmer head, the trimmer head being circular in configuration and comprising a forward end having an outside edge comprised of a radial configuration, a rearward end, a plurality of through holes that extend from the forward end to the rearward end, and an outer surface including an abrasive material;

b. operating a handheld rotary power tool with the trimmer head attached;

c. via the operation of the handheld rotary power tool, conveying air through the plurality of through holes in the trimmer head;

d. cooling the trimmer head while holding the toenail on the surface of the trimmer head via the conveying air through the trimmer head; and e. trimming the toenail by grinding it with the abrasive material.

2. The method of claim 1, additionally comprising steps of mechanically attaching the trimmer head to the handheld rotary power tool and driving the trimmer head with the handheld rotary power tool.

3. The method of claim 2, wherein the trimmer head comprises a splined opening engaging the handheld rotary power tool.

4. The method of claim 2, wherein the outside edge comprises a rounded edge.

5. The method of claim 2 wherein the trimmer head additionally comprises a concave center portion and the method additionally comprises using the concave center portion to keep toenails in place when grinding.

6. The method of claim 5 wherein the outside edge comprises a tapered radial configuration.

7. The method of claim 5, wherein the trimmer head is fixedly mounted to a shank comprising a near end and a distal end, said near end being thicker in cross-section than the distal end.

8. The method of claim 7, wherein the distal end of the shank is configured to fit the handheld rotary power tool.

9. The method of claim 5, wherein the plurality of through holes are aligned parallel to a long axis from the forward end to the rearward end.

10. The method of claim 5, wherein the plurality of through holes are angled with respect to a long axis from the forward end to the rearward end.

11. The method of claim 10, wherein the trimmer head additionally comprises at least one circumferential groove within the concave center portion.

12. The method of claim 9, wherein the trimmer head additionally comprises a mechanical attachment for mechanically attaching the trimmer head to the handheld rotary power tool.

13. The method of claim 12 wherein the mechanical attachment comprises internal threads.

14. The method of claim 12 wherein the mechanical attachment comprises a tapered press fit.

15. The method of claim 12 wherein the mechanical attachment comprises an opening and a set screw.

16. The method of claim 12 wherein the mechanical attachment comprises an opening and a retaining pin.

17. The method of claim 12 wherein the mechanical attachment comprises an opening and a spring-loaded button.

18. The method of claim 10, additionally comprising a step of conveying air into and out of the trimmer head via the plurality of through holes and cooling the trimmer head.

19. The method of claim 18, additionally comprising a step of diminishing vibration of the trimmer head via the conveying of air into and out of the trimmer head.

20. The method of claim 12, wherein the trimmer head additionally comprises a circumferential groove.

21. The method of claim 5, wherein the plurality of through holes do not intercept the outside surface of the trimmer head.

22. The method of claim 5, wherein the plurality of through holes intercept the outside surface of the trimmer head.

23. The method of claim 22, wherein the trimmer head comprises a tapered radial configuration and the plurality of through holes intercept the outside surface of the trimmer head outside edge.

24. The method of claim 22, wherein the plurality of through holes do not intercept the outside surface of the trimmer head.

25. The method of claim 22, wherein the outer surface comprises a circumferential groove and the plurality of through holes intercept the circumferential groove.

* * * * *